US005123280A

United States Patent [19]

Baechler

[11] Patent Number: 5,123,280

[45] Date of Patent: Jun. 23, 1992

[54] DEVICE FOR MEASURING THE THICKNESS AND/OR THE UNEVENNESS OF SLIVERS

[75] Inventor: Francois Baechler, Wermatswil, Switzerland

[73] Assignee: Zellweger Uster AG, Uster, Switzerland

[21] Appl. No.: 707,065

[22] Filed: May 29, 1991

[30] Foreign Application Priority Data

May 30, 1990 [CH] Switzerland ..... 01832/90

[51] Int. Cl.[5] ..... G01L 5/00

[52] U.S. Cl. ..... 73/160; 19/0.23; 19/150

[58] Field of Search ..... 73/159, 160; 19/0.23, 19/98, 150, 157; 28/227, 228

[56] References Cited

U.S. PATENT DOCUMENTS

| | | | |
|---|---|---|---|
| 2,680,266 | 6/1954 | Kershaw | 19/157 |
| 3,822,590 | 7/1974 | Tharpe et al. | 73/160 |
| 3,854,330 | 12/1974 | Wildbolz | 73/160 |
| 4,646,387 | 3/1987 | Oswald et al. | 19/0.23 |
| 4,864,853 | 9/1989 | Grunder et al. | 73/160 |
| 5,018,246 | 5/1991 | Leifeld | 19/150 |

OTHER PUBLICATIONS

*Uster News Bulletin*, "Autolevelling systems at carding and drawing from technological point of view" No. 30/Aug. 1982.

*Primary Examiner*—William A. Cuchlinski, Jr.
*Assistant Examiner*—W. Morris Worth
*Attorney, Agent, or Firm*—Burns, Doane, Swecker & Mathis

[57] ABSTRACT

A sliver measuring device includes a pair of rollers (6, 7) which limit two sides of a rectangular measuring space (3). A third side of the measuring space (3) is closed off by a guide roller (8) or by a guide plate. A measuring element (5) for the thickness or non-uniformity of the sliver is arranged on a fourth side of the measuring space. The rollers (6, 7) serve to compact the sliver in the measuring space. The measuring element (5) is formed by a leaf spring provided with strain gauges. Since the sliver is actively driven at the measuring point, this leads to an increase in the compaction of the sliver and thus to an increase in the measuring accuracy dependent upon the compaction. On the other hand, the inertia of the measuring element is very low.

12 Claims, 3 Drawing Sheets

FIG. 1
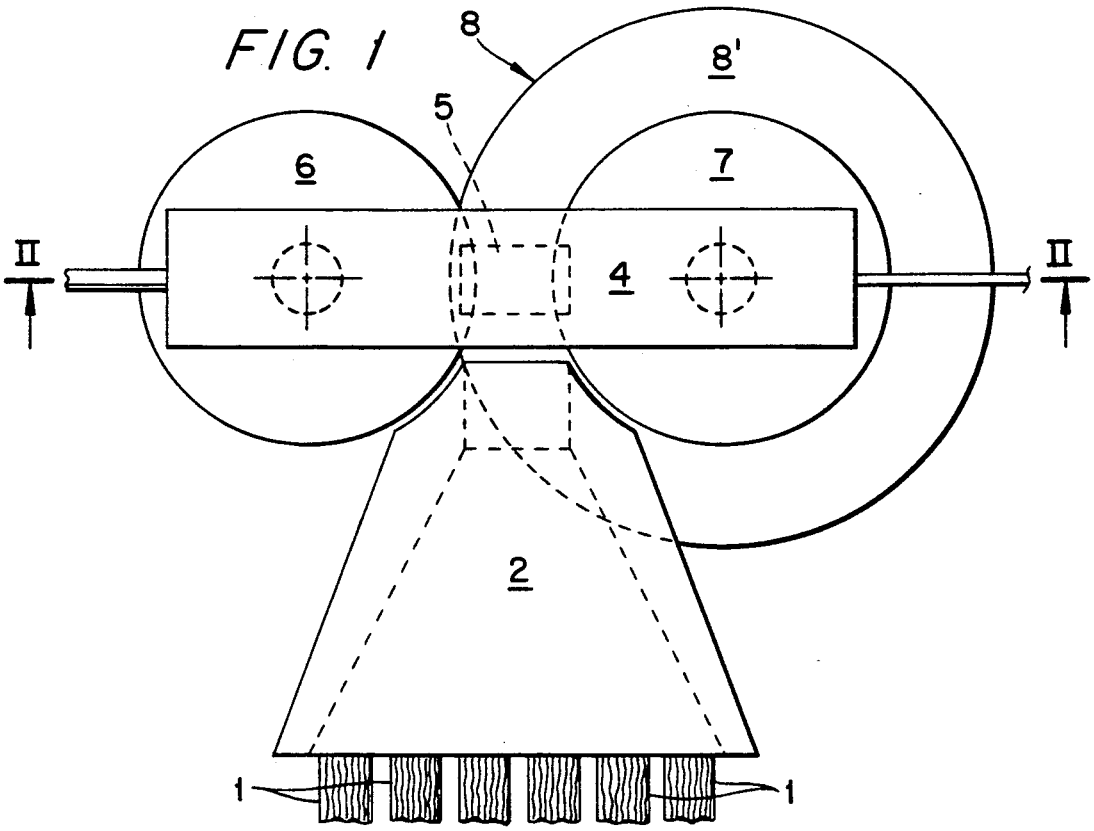
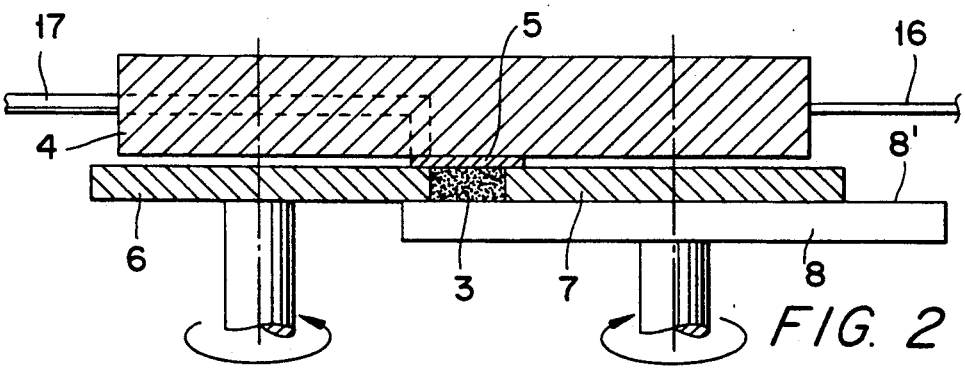
FIG. 2
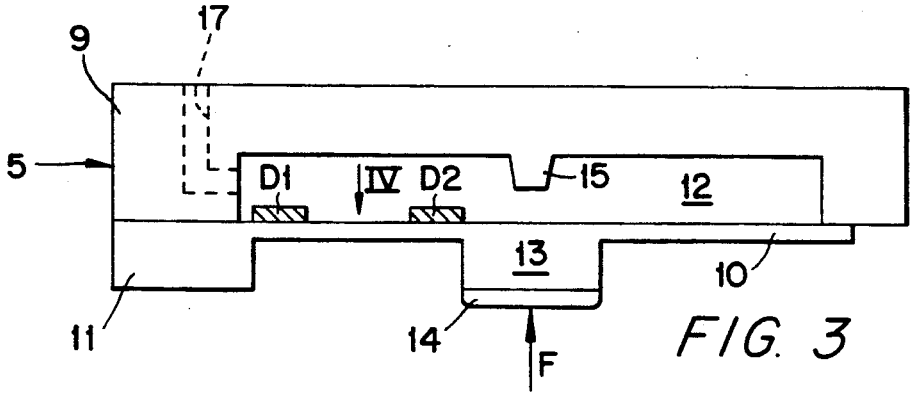
FIG. 3

FIG. 8
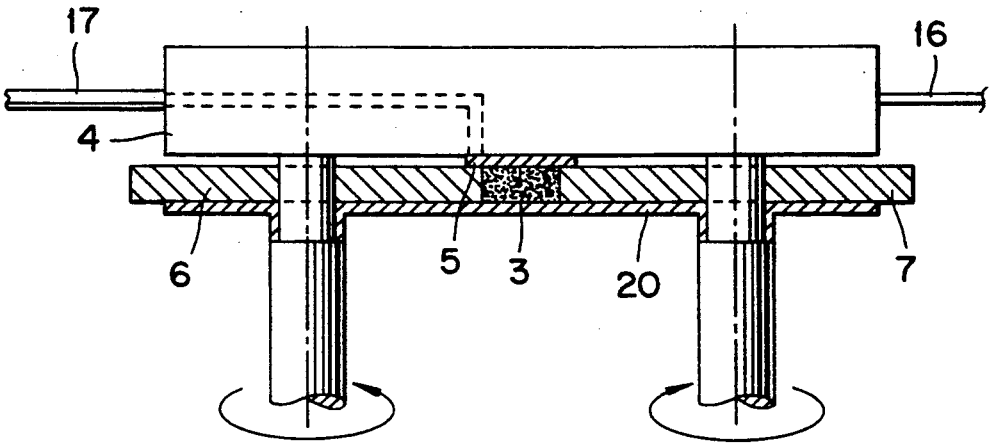
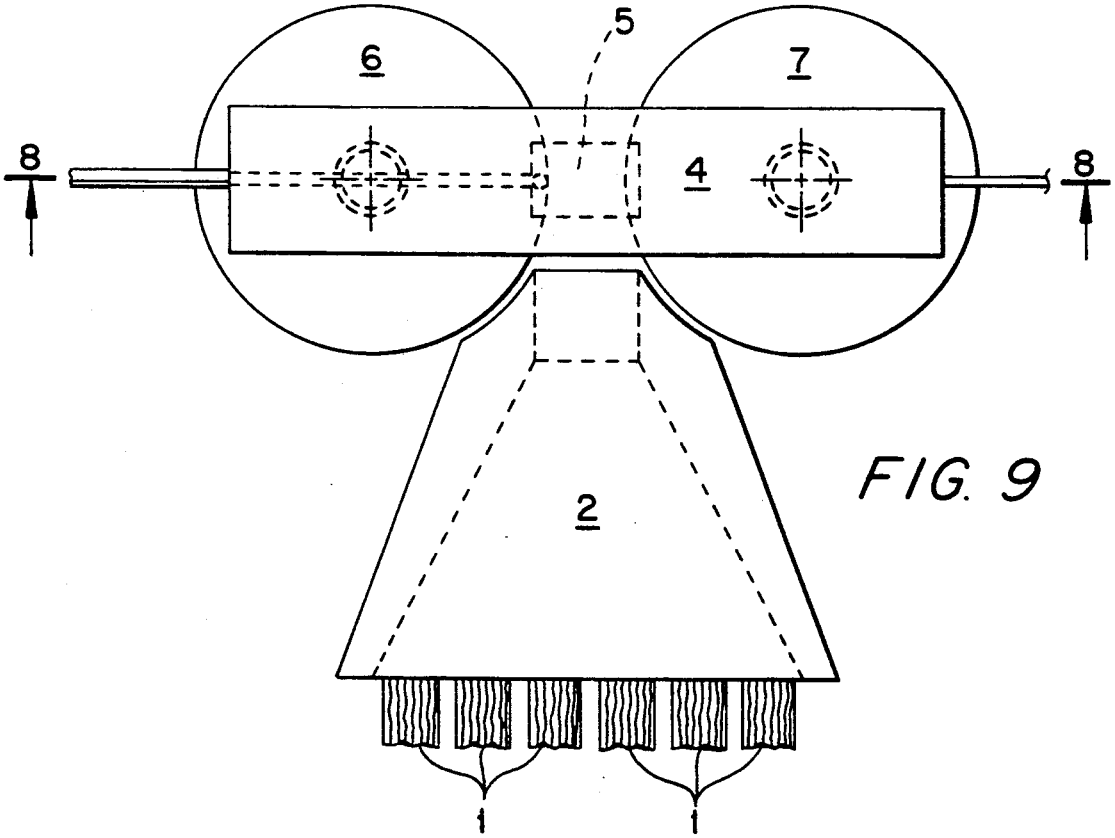
FIG. 9

DEVICE FOR MEASURING THE THICKNESS AND/OR THE UNEVENNESS OF SLIVERS

FIELD OF THE INVENTION

This invention relates to a device for measuring the thickness and/or the unevenness of slivers. It is intended particularly for use on machines for preparing textile fibers such as cotton for spinning. The device includes a compaction element compacting the sliver and a measuring element for the thickness or non-uniformity of the sliver, which measuring element mechanically scans the compacted sliver and is formed by a leaf spring provided with strain gauges.

BACKGROUND

Devices of this general type are used for systems for stabilizing fluctuations in sliver weight and for detecting the quality at cards, carding machines and draw frames. Such systems serve to keep the fluctuations in yarn number or count in the yarn being produced so small that the fluctuations do not spoil the properties in the finished product. The main differences in the known regulating systems lie in the measuring elements employed in them. Essentially three types of these measuring elements are known: the so-called actively pneumatic measuring element; the roller measuring system; and the fiber pressing system. With regard to the first two measuring elements, reference is made to the USTER News Bulletin No. 30, Jun. 1982. With regard to the last-mentioned measuring element, reference is made to U.S. Pat. No. 4,864,853.

In U.S. Pat. No. 4,864,B53, the sliver is scanned by a measuring element formed by a leaf spring. The sliver contacts the leaf spring in a measuring channel which is provided in a measuring part interchangeably arranged on the compaction element. This has the advantage that the entire compaction element does not need to be exchanged in order to adapt the device for measuring work in connection with slivers of different counts. On the contrary, only the measuring part needs to be exchanged. This device has proved excellent in practice, but it has been found that there are certain limits to the measuring accuracy. It may be supposed that this is directly connected with the compaction of the sliver, the so-called filling factor, which might well be limited by the spatial separation of compaction element on the one hand and measuring element on the other hand.

In the roller measuring system, the sliver is compacted by a pair of measuring rollers between which the sliver is pressed together. Here, compaction element and measuring element are not spatially separate; on the contrary, both functions are exercised by the measuring rollers. The two rollers are designed to overlap one another to prevent the sliver from coming laterally out of the clamping gap, and in fact they are designed either as stepped rollers or as so-called grooved and scanning rollers. The grooved- and scanning-roller measuring element is also known by the designation tongue and groove. Although a relatively high compaction of the sliver is obtained with the roller measuring system, this measuring system is very sluggish for this purpose on account of its relatively high mass moment of inertia, so that it is unable to outweigh the advantages of the fiber pressing system described in U.S. Pat. No. 4,864,853.

SUMMARY OF THE INVENTION

In one aspect of the present invention, there is provided a measuring device capable of very high measuring accuracy but having as low an inertia as possible, so that it can reliably detect slight and brief fluctuations in the sliver weight. This is achieved in a construction such that the compaction element is formed by a pair of rollers which limit two sides of a rectangular measuring space. This space is closed on three sides and the measuring element is arranged on a fourth side.

The arrangement of the measuring space between the measuring rollers compacting the sliver has the advantage that the measuring accuracy increases. The sliver is actively driven at the measuring point and this increases the compaction of the sliver and thus the filling factor in the measuring space. And since the measuring accuracy increases with increasing filling factor, the measuring accuracy will increase. The measuring element formed by a leaf spring provided with strain gauges also enables very short non-uniformities to be measured, and in fact even at high sliver speed.

BRIEF DESCRIPTION OF THE DRAWINGS

Exemplary embodiments of the invention are described in greater detail below with reference to the drawings, in which:

FIG. 1 shows a schematic plan view of a device according to the invention;

FIG. 2 shows a section along line II—II in FIG. 1;

FIG. 3 shows a detail of FIG. 2;

FIG. 8 is a view similar to FIG. 2 but showing another embodiment, this view being taken along the line 8—8 in FIG. 9; and FIG. 9 is a view similar to FIG. 1 but showing the embodiment of FIG. 8.

DETAILED DESCRIPTION OF PREFERRED EMBODIMENTS

Figure 4:
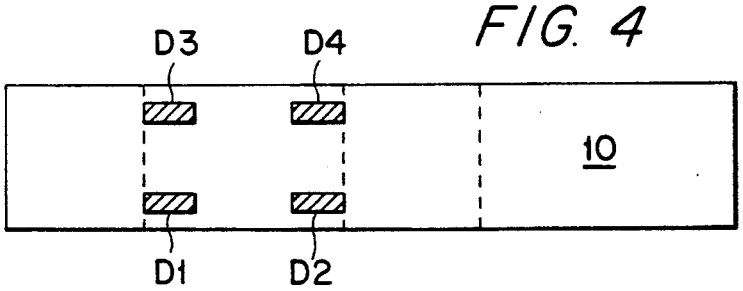
FIG. 4 shows a view in the direction of arrow IV in FIG. 3.

According to FIGS. 1–2, a single sliver or a number of slivers 1 (up to eight) are brought together by a conically converging funnel 2 and fed to a measuring space 3. The measuring space 3 has a rectangular cross-section which is closed off on three sides and on whose fourth side a measuring cell 4 having a measuring element 5 is arranged.

Figure 7:
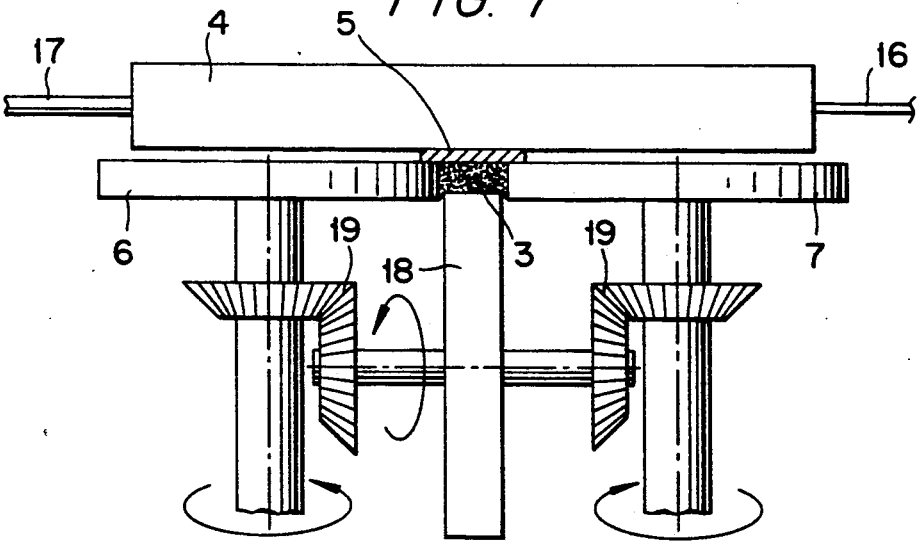
FIG. 7 shows a variant of the device in FIG. 1.

The means limiting the measuring space 3 include two rollers 6 and 7 which are driven in the direction of the arrows shown in FIG. 2 and have a smooth or grooved periphery. A guide roller 8 adjoins one of these rollers (the right-hand roller 7 in FIGS. 1–2). This guide roller 8 projects beyond the roller 7 in diameter and provides a shoulder 8 adjacent to the roller 7 to laterally limit the measuring space 3. This limit can of course also be brought about by other means, for example by a fixed guide plate. Another possibility is shown in FIG. 7.

The distance between the axes of the two rollers 6 and 7 is adjustable, and thus the cross-section of the measuring space 3 and the degree of compaction of the sliver 1 in the measuring space 3 are likewise adjustable. When a sliver is referred to in this connection, this means the sliver in the measuring space 3. In this space, there is a single sliver, irrespective of how many slivers 1 are fed to the funnel 2.

If the device shown in FIGS. 1 and 2 is used at a draw frame, it is arranged at the outlet and/or at the inlet of the draw frame. The cross-section of the sliver 1 passing through the measuring space 3 is scanned by the measuring element 5, as a result of which a corresponding cross-section signal is delivered to an electronic control system. The electronic control system processes this cross-section signal to form a suitable regulating and/or control signal which is fed to a regulating drive for the pair of drawing rollers of the draw frame. Depending on the degree of compaction in the measuring space 3, the sliver will exert a certain force or a certain pressure on the measuring element 5, the size of which, for a given cross-section of the measuring space 3, is proportional to the thickness of the sliver and thus also reliably indicates non-uniformities in this thickness.

Accordingly, the measuring element 5 is designed for measuring the acting pressure and, according to FIGS. 3 and 4, consists of a support 9 and a leaf spring 10 which is carried by the support 9 and which has a thicker portion 11 at one of its ends and is firmly connected, preferably clamped, to the support 9 at this thicker portion 11. The leaf spring 10 rests on corresponding webs of the support 9, between which an intermediate space 12 is formed which enables the leaf spring 10 to bend on account of the action of a force F.

In its area in contact with the sliver 1, the leaf spring 10 has a web 13 which carries a measuring lamina 14 made of nonabrasive material, preferably hard metal or ceramic, which measuring lamina 14 bears on the sliver 1 and absorbs its pressure F. A stop 15 in alignment with the web 13 is arranged in the intermediate space 12 for limiting the deflection of the leaf spring 10 in order to prevent overstraining or overstressing of the leaf spring 10.

At least two strain gauges are arranged on the side of the leaf spring 10 facing the intermediate space 12. Strain gauges D1 to D4 are adhesively bonded or sputtered onto the leaf spring. The sliver 1 passing through the measuring space 3 presses with a force F against the measuring lamina 14, as a result of which the leaf spring 10 is pressed towards the intermediate space 12 and is thus deformed. This results in a strain at the strain gauges D2 and D4 adjacent to the measuring lamina 14 and a compression at the strain gauges D1 and D3 adjacent to the thicker end 11 of the leaf spring 10.

Figure 5:
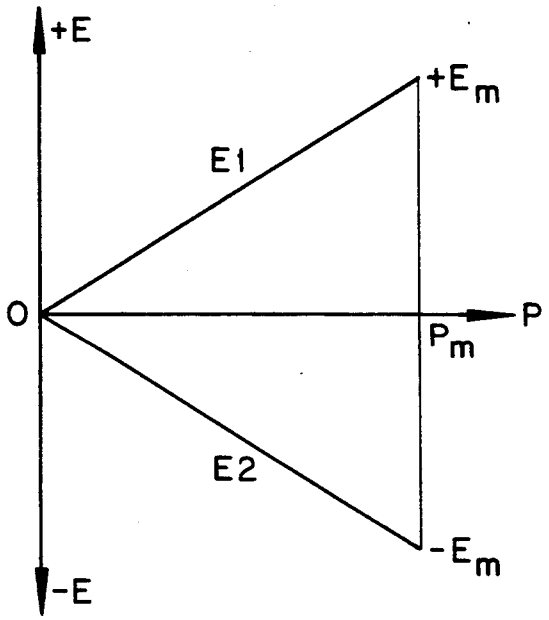
FIGS. 5 and 6 show schematic representations for explaining the function.

This is shown in FIG. 5, in which the strain E, which is a function of the force F, is plotted against the deflection P of the leaf spring 10. With increasing force F and thus increasing deflection P of the leaf spring 10, the strain El at the strain gauges D2 and D4 on the one hand and the compression E2 (=negative strain) at the strain gauges D1 and D3 on the other hand constantly increase and each will reach a maximum value +Em and −Em respectively, which is present when the leaf spring 10 takes the position of maximum deflection Pm, i.e. when it is bent up to the stop 15 (FIG. 3).

Figure 6:
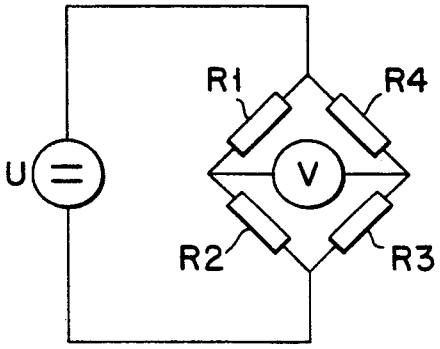

Each strain gauge D1 to D4 has a certain electrical resistance R1 to R4, these resistances all being the same. Since the relative change in resistance during bending of the leaf spring 10 is known to be proportional to the strain of the strain gauges, the strain can be determined by measuring this change in resistance. This takes place according to FIG. 6 with a Wheatstone bridge circuit which consists of four branches which are formed by the resistances R1 to R4 interconnected in a closed loop. If a supply voltage U is now applied to the connecting points between the resistances R1 and R4 on the one side and R2 to R3 on the other side, an output voltage V proportional to the bridge unbalance can be tapped at the two remaining connecting points, which output voltage V is in turn proportional to the sum of the strain of the individual strain gauges D1 to D4.

According to FIG. 2, the measuring cell 4 has a corresponding connecting cable 16 for the electrical connection of the strain gauges D1 to D4 as well as a hose connection 17. The latter serves to connect a compressed-air hose for the automatic cleaning and cooling of the measuring cell 4 and the measuring element 5 in the are of the intermediate space 12 and in the area of the web having the measuring lamina 14. In this arrangement, the air is fed pulse-like to the connection 17 in the form of compressed-air surges whose frequency and duration can be adjusted.

It is an exceptionally simple task to adapt this measuring device for measuring slivers of varying thicknesses. This can be carried out in various ways such as use of rollers 6 and 7 having different diameters; use of rollers 6 and 7 having different widths; use of rollers 6 and 7 having different diameters and widths; and changing the distance between the axes of the rollers 6 and 7.

A variant of the device shown in FIGS. 1 and 2 is shown in FIG. 7. In this view, the side of the measuring space 3 opposite the measuring cell 4 is not closed off by the shoulder of a guide roller or by a guide plate but by the periphery of a guide roller 18 which is arranged perpendicularly to the two rollers 6 and 7. This roller 18 engages the sliver between the rollers 6 and 7 and is coupled to the rollers 6 and 7 as a drive via gears 19.

FIGS. 8 and 9 illustrate another embodiment of the invention in which the side of the measuring space 3 opposite the measuring cell 4 is closed off by a guide plate 20 fixed in position with respect to the rollers 6 and 7. In this embodiment, there is no need for a guide roller, such as the guide roller 8 illustrated in FIGS. 1 and 2. The remaining parts of this embodiment are comparable to those in the embodiment of FIGS. 1 and 2.

What is claimed is:

1. Device for measuring the thickness and/or the unevenness of slivers, in particular on preparatory spinning machines, having a compaction element compacting the sliver and a measuring element for the thickness or non-uniformity of the sliver, which measuring element mechanically scans the compacted sliver and is formed by a leaf spring provided with strain gauges, wherein the compaction element is formed by a pair of rollers (6, 7) which limit two sides of a rectangular measuring space (3) which is closed on three sides and on whose fourth side the measuring element (5) is arranged.

2. Device according to claim 1, wherein the third side of the measuring space (3) is closed off by a guide roller (8, 18).

3. Device according to claim 2, wherein the rollers (6, 7) are driven, and in that the guide roller (8) is arranged on the drive spindle of one of the rollers and directly next to this roller and has a shoulder covering the third side of the measuring space (3).

4. Device according to claim 2, wherein the rollers (6, 7) are driven, and in that the guide roller (18) is arranged perpendicularly to the rollers and is coupled to the latter as a drive and, with its periphery, engages between the rollers on the third side of the measuring space (3).

5. Device according to claim 1, wherein the third side of the measuring space (3) is closed off by a guide plate.

6. Device according to claim 1, wherein the leaf spring (10) is of elongated design and is fastened at one end (11) to a support (9).

7. Device according to claim 6, wherein the leaf spring (10) is oriented in the direction of the straight connecting line between the axes of the two rollers (6, 7).

8. Device according to claim 7, wherein the leaf spring (10), in its center part, is provided with a web (13) which carries a measuring lamina (14) provided for contacting the sliver (1).

9. Device according to claim 8, wherein at least one pair of strain gauges (D1–D4) is provided, of which one is arranged adjacent to the said web (13) and the other is arranged adjacent to said one end of the leaf spring (10).

10. Device according to claim 9, wherein the strain gauges (D1–D4) are arranged on a side of the leaf spring (10) remote from the web (13) having the measuring lamina (14).

11. Device according to claim 10, including a supply of compressed air; and wherein at the side of the leaf spring (10) carrying the strain gauges (D1–D14), an intermediate space (12) is formed between this leaf spring (10) and its support (9), supplying compressed air for cooling and/or cleaning purposes.

12. Apparatus for measuring the thickness and/or unevenness of slivers, comprising means defining a rectangular space through which a compacted sliver to be measured passes; said means including a pair of opposed rollers on opposite sides of said sliver and defining two sides of said rectangular space, a member having a surface defining a third side of said rectangular space, and a measuring element defining the fourth side of said rectangular space and being in position to be pressed against by the compacted sliver in said space with a force proportional to the thickness of such compacted sliver.

* * * * *